US005196894A

United States Patent [19]

Merle et al.

[11] Patent Number: 5,196,894

[45] Date of Patent: Mar. 23, 1993

[54] TONER IMAGE FUSING AND COOLING METHOD AND APPARATUS

[75] Inventors: Thomas C. Merle, Rochester; John P. Swapceinski, Bergen, both of N.Y.

[73] Assignee: Eastman Kodak Company, Rochester, N.Y.

[21] Appl. No.: 817,033

[22] Filed: Jan. 3, 1992

[51] Int. Cl.[5] ..... G03G 15/20

[52] U.S. Cl. ..... 355/285; 355/290; 355/326; 219/216; 118/60

[58] Field of Search ..... 355/290, 295, 285; 430/33, 98, 99; 219/216; 118/60

[56] References Cited

U.S. PATENT DOCUMENTS

| | | | |
|---|---|---|---|
| 3,948,215 | 4/1976 | Namiki | 118/60 |
| 4,780,742 | 10/1988 | Takahashi et al. | 355/3 FU |
| 4,927,727 | 5/1990 | Rimai et al. | 430/99 |
| 4,968,578 | 11/1990 | Light et al. | 430/126 |
| 5,012,291 | 4/1991 | Buchan et al. | 355/271 |
| 5,021,835 | 6/1991 | Johnson | 355/271 |
| 5,023,038 | 6/1991 | Aslam et al. | 264/293 |
| 5,085,962 | 2/1992 | Aslam et al. | 355/285 X |
| 5,099,288 | 3/1992 | Britto et al. | 355/285 X |

FOREIGN PATENT DOCUMENTS

| | | |
|---|---|---|
| 0295901 | 6/1988 | European Pat. Off. . |
| 0301585 | 7/1988 | European Pat. Off. . |

OTHER PUBLICATIONS

"Belt Fusing Device", *Research Disclosure*, Jul. 1990, p. 559.

*Primary Examiner*—Richard L. Moses
*Attorney, Agent, or Firm*—Leonard W. Treash

[57] ABSTRACT

A toner image is fixed to a receiving sheet by positioning the image between the receiving sheet and a hard surface of a web or sheet. Pressure is applied between the surfaces to fix the toner image to the receiving sheet with the toner image above its glass transition temperature. While the surfaces are still in contact, a heat sink member is brought into contact with one of the sheets or web to remove heat from the toner image and reduce the temperature of the toner image below its glass transition temperature allowing the receiving sheet to be separated from the hard surface without offset.

9 Claims, 2 Drawing Sheets

TONER IMAGE FUSING AND COOLING METHOD AND APPARATUS

TECHNICAL FIELD

This invention relates to the fixing of toner images to a receiving sheet. Although not limited thereto, it is particularly useful in fixing high-quality multicolor images to a receiving sheet using heat and pressure.

BACKGROUND ART

A number of references show the use of endless belts to fix toner images to paper, transparency stock or the like; see, for example, U.S. Pat. No. 3,948,215; European Applications 0301585 and 0295901. Typically, in these fixing processes a combination of heat and pressure is applied between an endless belt and a pressure roller with the toner image on a receiving sheet facing the endless belt. The toner image is left in contact with the endless belt until the image is cooled below the glass transition temperature of the toner, at which point the receiving sheet can be separated without offset.

U.S. Pat. No. 4,968,578, Light et al, issued Nov. 6, 1990; U.S. Pat. No. 4,927,727, Rimai et al, issued May 22, 1990; and U.S. Pat. No. 5,021,835, Johnson, issued Jun. 4, 1991, all described a heat-assisted toner image transfer method. Two or more single color images are transferred in registration from an image member to a receiving sheet having a heat softenable thermoplastic outer layer, by heating the receiving sheet to an elevated temperature. The temperature of the receiving sheet is sufficiently above the softening point of the toner and of the layer that the toner sticks to the receiving sheet. This method is particularly useful in transferring extremely small, dry toner particles, for example, toner particles having a mean particle diameter of 8 microns or less.

Especially in transferring a series of single color toner images to a form multicolor toner image, the layers of toner pile up above the level of the receiving sheet even when substantial pressure is used in transfer. This results in an unacceptable relief image corresponding generally to the optical density of the image. U.S. Pat. No. 5,023,038 to Aslam et al, issued Jun. 11, 1991; U.S. Pat. No. 5,089,363 to Rimai et al, describe a method of fixing such toner images to a receiving sheet which receiving sheet has an outer heat-softenable thermoplastic layer. The relief image is substantially reduced, the image is more permanently fixed and gloss can be increased by bringing the image into contact with a ferrotyping surface, for example, a hard surface of a metal belt, under conditions of heat and pressure which cause the image to be further embedded in the thermoplastic layer. In addition to being hard, the ferrotyping surface has good release. For example, it can be made of nickel, stainless steel or other metals, with or without surface treating with silicones or the like. The ferrotyping surface can be textured to provide a matte or other textured finish to the image, or it can be smooth to enhance its gloss.

In designing a continuous production image forming apparatus the ferrotyping surface is formed on a web. The web is usually in the form of an endless belt, but it is also known to be quite long and have supply and take-up rolls for continuous operation.

As in the earlier cited belt fixing apparatus, the toner image and the thermoplastic layer are left in contact with the belt until they are cooled below their glass transition temperatures before separation. Preventing offset by cooling in contact with the web eliminates the need for offset preventing liquids which have a degrading affect on a high quality image.

A problem in using a web system, especially an endless belt system in a productive image forming apparatus is associated with the time required for the belt and image to cool while maintained in contact. If the fixing device is moved at a speed below the speed of the transfer station to allow cooling, then the mismatch of speeds between the transfer station and the fixing device must be accommodated. In general, this requires either a full-frame distance in the in-track direction between the transfer station or drum and the fixing device, or a loop or other mechanism absorbing the difference in speeds.

A number of references suggest actively cooling the belt and receiving sheet combination to reduce the necessary size of the belt required. For example, "Belt Fusing Device", *Research Disclosure*, July 1990, Page 559, suggests a heat pump device which removes heat from the portion of the belt leading away from the pressure applying members and transfers the heat to the portion of the belt approaching the pressure applying members. In U.S. patent application Ser. No. 07/754,489 filed Sep. 3, 1991 to J. P. Swapceinski et al shows a heat transferring roller positioned between portions of an endless belt fuser to conduct heat from the cooling portions to a portion about to be heated. U.S. Pat. Nos. 4,780,742 and 3,948,215 suggest air cooling the belt and receiving sheet after it leaves the pressure applying members. See also U.S. Pat. No. 5,012,291; 3,356,831; 3,948,215 for other cooling and heating devices for belt fusers.

U.S. patent application Ser. No. 07/783,475 to Johnson and Merle, entitled IMAGE FORMING APPARATUS INCLUDING TONER IMAGE FIXING DEVICE USING FUSING SHEETS, filed Oct. 28, 1991, suggests using a finite or a cut fusing sheet instead of an endless belt which fusing sheet can form a sandwich with the receiving sheet which can be moved much slower or not at all during the cooling process after leaving a pair of pressure members that can be allowed to run at full machine speed.

DISCLOSURE OF THE INVENTION

It is an object of this invention to provide a toner image fixing method and apparatus in which a toner image is fixed to a receiving sheet by pressure applied between the receiving sheet and a hard surface and in which contact is maintained with the hard surface until the toner image has cooled, but without some or all of the problems associated with the time it takes to cool the image.

This and other objects are accomplished by a method and apparatus in which toner image is fixed to a surface of a receiving sheet by placing the receiving sheet surface in contact with a hard surface of a web or sheet with the toner image between the receiving sheet surface and the hard surface. With the toner image at or above its glass transition temperature, sufficient pressure is applied between the surfaces to fix the toner image to the receiving sheet. Then, while the surfaces are still in contact, the backside of at least one of the sheets or web is contacted by a heat sink member to remove rapidly heat from the toner image and reduce the temperature of the toner image below its glass transition temperature. If the receiving sheet has a heat-softenable layer holding the toner image, it is also cooled below its softening point. After the toner image is sufficiently cooled the receiving sheet is separated from the hard surface.

According to a preferred embodiment, the hard surface is a surface of an endless belt which is driven between pressure applying members with the receiving sheet at full machine process speed. Once the receiving sheet has left the pressure applying position, the belt is stopped and the heat sink member is brought into contact, preferably with the backside of the receiving sheet to absorb heat from the receiving sheet cooling the toner image. Once the toner image is cooled, the heat sink member is moved away and the belt started up again to facilitate conventional separation of the receiving sheet.

According to another preferred embodiment the hard surface is a surface of a separate finite fusing (or other) sheet having leading and trailing edges. The sheets are fed between pressure applying members at full machine speed creating a sandwich with a hot toner image fixed to the receiving sheet. After the sheets have passed through the pressure applying members, one or both of them are contacted by one or more heat sink members to again cool the image prior to separation.

Utilizing the invention, actual pressure fixing can be accomplished at full machine speed. For example, the pressure applying members can be positioned immediately adjacent a transfer drum and operated at the same speed as the transfer drum without accommodation for a difference in speed between fixing and transfer. The receiving sheet can then be cooled quite rapidly by contact between the heat sink member and a stopped web or sheet. This allows extremely rapid cooling and does not elongate the apparatus for a lengthy cooling run of the belt or web.

DISCLOSURE OF THE PREFERRED EMBODIMENTS

Figure 1:
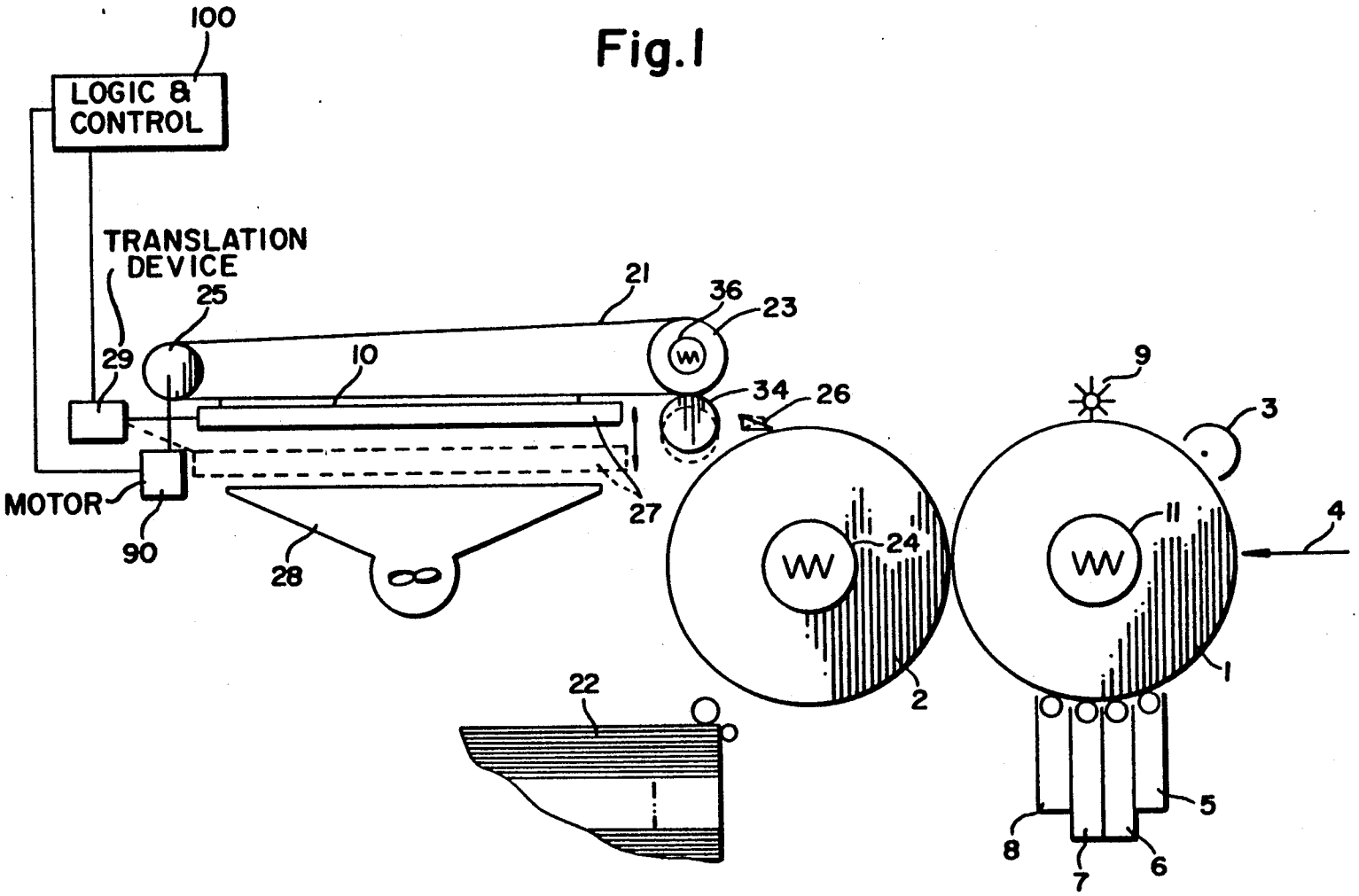
FIGS. 1 and 2 are side schematics of image forming apparatus constructed according to alternative embodiments of the invention.

According to FIG. 1, an image member, for example, photoconductive drum 1, is utilized to create a series of different color toner images. More specifically, an electrophotosensitive outer surface of drum 1 is uniformly charged by a charging device 3 and imagewise exposed by an exposing device, for example, a laser 4, to create a series of electrostatic images. Each electrostatic image is toned by a different one of toning stations 5, 6, 7 and 8, each toning station containing a different color toner to create a series of different color, single color, toner images.

The series of toner images are transferred in registration to a receiving sheet carried on the outside surface of a transfer drum 2, which receiving sheet has been fed from a receiving sheet supply 22. Transfer is accomplished by a combination of heat and pressure. Heat is furnished primarily from a lamp 24 located inside transfer drum 2 which heat warms the receiving sheet to a temperature sufficient to at least sinter the toner particles contacting it where the particles touch the receiving sheet and each other. To assist in this process the image member 1 can also be heated internally by a lamp 11 to a temperature greater than ambient, but not so high that it damages the photoconductive properties of drum 1 or causes the toner to stick to drum 1. Transfer can be assisted by a receiving sheet having an outside layer of a heat softenable material into which the first layer or two of toner particles is at least partially embedded. A transfer drum 2 rotates once for transfer of each image to form a multicolor image on the receiving sheet surface.

After the multicolor image has been completely formed on the receiving sheet, a skive 26 is moved into position to skive the receiving sheet off drum 2 and direct it between a pair of pressure applying members, for example, pressure rollers 23 and 34. An endless belt 21, having a hard outwardly facing surface, is trained about roller 23 and a separation roller 25 and is driven by an intermittently driveable motor 90 in a clockwise direction (as seen in FIG. 1). Roller 23 is internally heated by a lamp 36 to maintain the toner image and any heat-softenable layer of the receiving sheet above their glass transition temperatures as the receiving sheet passes between the pressure applying members 23 and 34. Pressure roller 34 can also be heated and is articulatable away and into contact with belt 21 to allow the receiving sheet to be positioned well into the nip before the pressure is applied. This prevents a dwell of the leading edge of the receiving sheet as it enters the nip which can cause hot offset of a heat-softenable outer layer of the receiving sheet onto belt 21.

A force is applied between rollers 23 and 34 to create sufficient pressure between the hard surface of belt 21 and the image bearing surface of the receiving sheet to fix the image to the receiving sheet. If the receiving sheet has a heat-softened layer, the image will be further embedded in the layer and toner image relief reduced as part of the fixing process.

After the trailing edge of the receiving sheet passes through the pressure applying members 23 and 34, motor 90 is stopped, stopping belt 21 with the receiving sheet adhering to the belt because of the still soft toner (and heat-softenable thermoplastic layer, if any). At the same time, a heat sink member 27 is moved by a translation device 29 into contact with the rear of receiving sheet 10.

Heat sink member 27 is preferably made of a material of high thermal conductivity and mass, for example, copper or aluminum. It is maintained substantially below the glass transition temperature of the toner, for example, as close to ambient as possible in a fuser area. Because of its high conductivity and thermal mass, it has substantial heat absorbing affect on receiving sheet 10. When in contact with heat sink member 27, receiving sheet 10 rapidly cools until the toner image and any heat-softenable layer are below their glass transition temperatures. At this point the translation device 29 is actuated again to move heat sink member 27 away from receiving sheet 10 and the motor 90 is begun again to rotate belt 21 driving receiving sheet 10 past separation roller 25 where (because of its stiffness) it separates from belt 21 and can pass onto an output hopper, not shown, or other processing stations. Heat sink member 25 is continuously cooled by a forced air cooling device 28 which keeps it as close to ambient temperature as possible.

A logic and control 100 controls the timing of both the translation device 29 and intermittently driveable motor 90 to properly time the movement of belt 21 and of heat sink member 27.

With this structure, belt 21 and the pressure applying members 23 and 34 can drive the receiving sheet at exactly the same speed as it is moved by drum 2 so that the pressure applying members 23 and 34 can be located in close proximity to transfer drum 2. This greatly shortens the size of the apparatus and reduces the heat loss in the receiving sheet between drum 2 and the pressure applying members. Despite the substantial speed of the pressure applying members, belt 21 need not be made especially long to permit cooling of receiving sheet 10 since the belt 21 is stopped for that cooling operation. Heat sink member 27 accomplishes extremely fast cooling which further increases the productivity of the machine. In fact, it is so rapid, it could be used while belt 21 is moving. However, this approach would require substantially more complex structure for articulating member 27 than if belt 21 is stopped.

Figure 2:
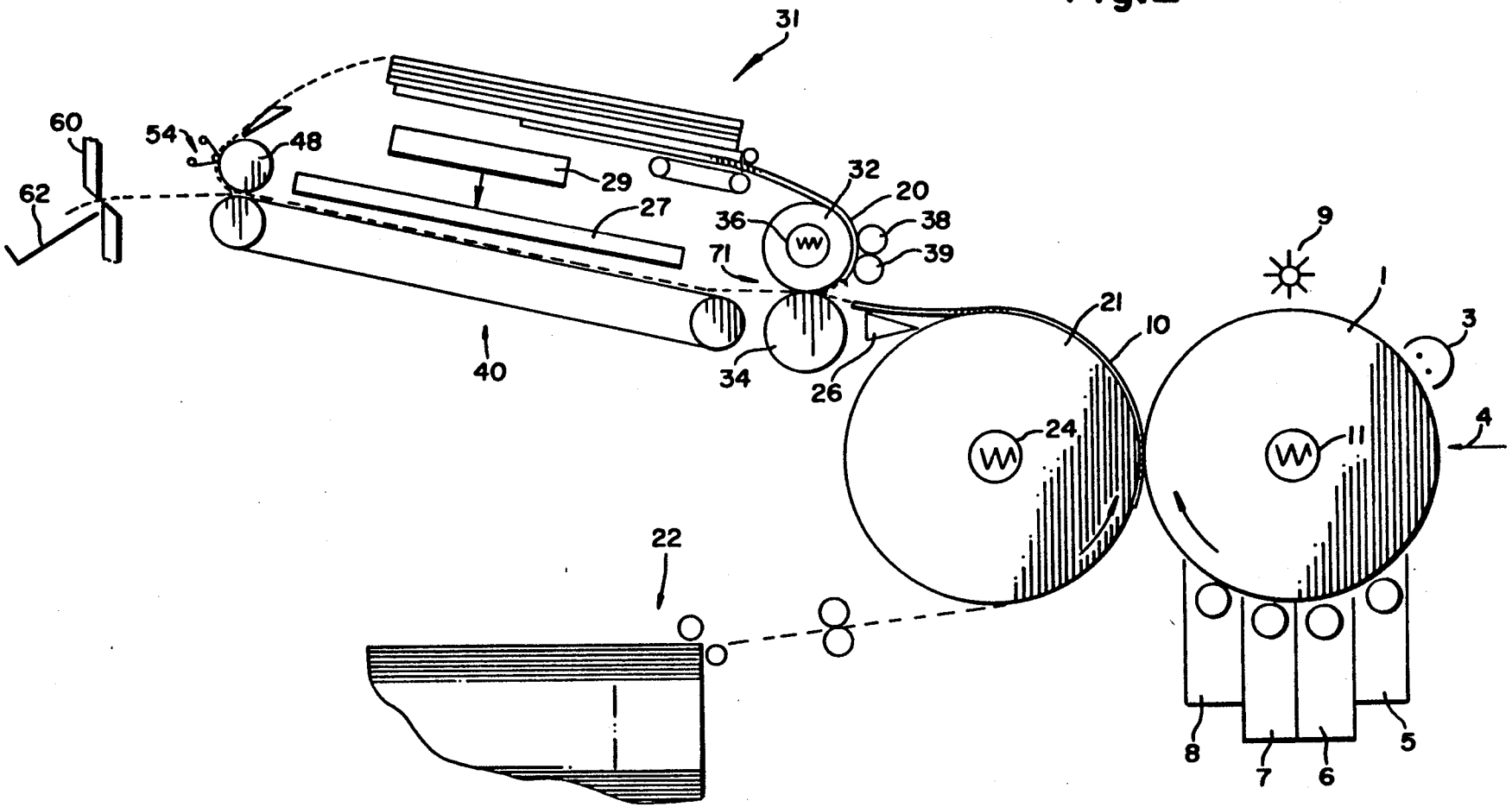

FIG. 2 shows an alternative embodiment of the invention in which the toner images are formed as in FIG. 1 and transferred in registration to receiving sheet 10. Receiving sheet 10 is fed into a nip 71 between pressure applying rollers 32 and 34 while the image bearing surface of receiving sheet 10 is being overlaid with a fusing sheet 20. Fusing sheet 20 is fed from fusing sheet supply 31 and has a hard ferrotyping surface which is fed into contact with the image bearing surface of receiving sheet 10. Fusing sheet 20 is preheated by early contact with heated roller 32, assisted by scuff rollers 38 and 39 which hold fusing sheet 20 against heated roller 32. Fusing sheet 20 and receiving sheet 10 form a sandwich between which the toner image is positioned. The heat and pressure of pressure members 32 and 34 fix the toner image to the receiving sheet surface as in the FIG. 1 embodiment.

The sandwich exits nip 71 and is picked up by a transport 40 which transports the sandwich away from pressure applying members 32 and 34. After the trailing edges of the sheets have exited nip 71, the transport 40 is stopped and a translation device 29 moves a heat sink member 27 into contact with the rear of fusing sheet 20 cooling the sandwich, this time by contact with the back of the fusing sheet. The toner image (and any heat-softened layer on the receiving sheet) cools rapidly below its glass transition temperature because of the high thermal conductivity and mass of the heat sink member 27.

Transport 40 is begun again and the receiving sheet and fusing sheet are separated with the receiving sheet going to a cutter 60 and then to an output tray 62. The fusing sheet is cleaned by a cleaning device 54 and fed back to the fusing sheet supply 31. The fusing sheet can be separated from the receiving sheet by a suitable pawl mechanism, not shown, which engages an overlapped leading edge of the fusing sheet as the sandwich leaves the transport 40.

For highest gloss, the hard surface of belt 21 or sheet 20 can be any smooth hard surface. A textured surface can impart a silk or matte finish. Nickel or stainless steel belts are preferred, and can be treated with suitable silicones or other materials to enhance release. U.S. Pat. No. 5,023,038, cited above, is incorporated by reference for a more complete description of suitable materials and other details associated with the use of this invention with a heat-softenable layer on the receiving sheet.

The invention has been described in detail with particular reference to a preferred embodiment thereof, but it will be understood that variations and modifications can be effected within the spirit and scope of the invention as described hereinabove and as defined in the appended claims.

We claim:

1. A method of fixing a toner image to a surface of a receiving sheet, said method comprising:

placing the receiving sheet surface in contact with a hard surface of a web or sheet with a toner image between said receiving sheet surface and said hard surface, with said toner image at or above its glass transition temperature, moving said web or sheet and receiving sheet between a pair of pressure members while applying sufficient force urging said pressure members toward each other to fix said toner image to said surface of said receiving sheet, then, stopping said web or sheet and receiving sheet and while said surfaces are still in contact and are stopped, directly contacting at least one of said sheets or web with a heat sink member to remove heat from said toner image and reduce the temperature of said toner image below its glass transition temperature, and then separating said receiving sheet from said sheet or web.

2. A method according to claim 1 wherein said receiving sheet surface is a surface of a heat-softenable layer of said receiving sheet and said method includes the step of raising or maintaining said layer at or above its glass transition temperature for said pressure applying step.

3. A method according to claim 2 wherein said toner image is a multicolor image, at least partially embedded in said heat softenable layer.

4. The method according to claim 1 wherein said directly contacting step includes directly contacting said receiving sheet with said heat sink member.

5. Toner image fixing device comprising:

means for positioning a toner image between a receiving sheet and a hard surface of a sheet or web, means for raising or maintaining said toner image to a temperature at or above the glass transition temperature of the toner image, means for applying sufficient pressure between said receiving sheet and said hard surface to fix said toner image to said receiving sheet, a heat sink member means for positioning said heat sink member in contact with at least one of said sheets or said web to reduce the temperature of said fixed toner image below its glass transition temperature, and intermittent drive means actuable to move said sheet or web and said receiving sheet through said pressure applying means and stoppable to stop said sheet or web during contact between said heat sink member and said sheet or web or receiving sheet.

6. A toner image fixing device according to claim 5 wherein said hard surface is a surface of an endless belt and said pressure applying means includes a roller backing said belt.

7. A toner image fixing device according to claim 6 wherein said heat sink member is positioned to contact a side of said receiving sheet opposite to the surface to which said toner is fixed.

8. A toner image fixing device according to claim 5 wherein said hard surface is a surface of a sheet having leading and trailing ends and said pressure applying means is driveable to move said sheets through said pressure applying means as a sandwich and said device includes means for holding said sandwich stationary after passing through said pressure applying means during contact by said heat sink member.

9. A toner image fixing device according to claim 4 further comprising:

means for forming a series of electrostatic images on an image member, means for applying different color toners to each of said electrostatic images to form a series of different color toner images, means for transferring said different color toner images in registration to a receiving sheet, said means including heating said receiving sheet to a temperature sufficient to sinter toner particles in said toner image where said toner particles touch one another or said receiving sheet and means for applying pressure between said receiving sheet and said image member.

* * * * *